US009422834B2

(12) United States Patent
Fujii et al.

(10) Patent No.: US 9,422,834 B2
(45) Date of Patent: Aug. 23, 2016

(54) ROLLER LIFTER FOR INTERNAL COMBUSTION ENGINE

(71) Applicant: OTICS Corporation, Nishio (JP)

(72) Inventors: Hiroki Fujii, Aichi (JP); Kiyoshi Masegi, Aichi (JP)

(73) Assignee: OTICS Corporation, Nishio (JP)

( * ) Notice: Subject to any disclaimer, the term of this patent is extended or adjusted under 35 U.S.C. 154(b) by 0 days.

(21) Appl. No.: 13/914,920

(22) Filed: Jun. 11, 2013

(65) Prior Publication Data

US 2013/0340695 A1 Dec. 26, 2013

(30) Foreign Application Priority Data

Jun. 20, 2012 (JP) ..... 2012-138596

(51) Int. Cl.
*F01L 1/14* (2006.01)

(52) U.S. Cl.
CPC . *F01L 1/14* (2013.01); *F01L 1/143* (2013.01); *F01L 2105/00* (2013.01); *F01L 2105/02* (2013.01); *F01L 2107/00* (2013.01)

(58) Field of Classification Search
CPC ..... F01L 1/14; F01L 1/143; F01L 2107/00; F01L 2105/02; F01L 2105/00
USPC ..... 123/90.48, 90.5, 90.24
See application file for complete search history.

(56) References Cited

U.S. PATENT DOCUMENTS 3,267,919 A * 8/1966 Wortman ..... 123/188.11
3,886,808 A * 6/1975 Weber ..... 74/569
2006/0016406 A1* 1/2006 Geyer ..... 123/90.5
2010/0294219 A1 11/2010 Prokop
2012/0152187 A1* 6/2012 Cornett et al. ..... 123/90.5

FOREIGN PATENT DOCUMENTS

DE 10 2010 026 360 A1 1/2012
DE 10 2010 027 608 A1 1/2012
JP 2001-132413 A 5/2001
JP 2003-184514 A 7/2003
JP 2010-1884 1/2010

(Continued)

OTHER PUBLICATIONS

Extended European Search Report issued Oct. 9, 2013 in European Patent Application No. 13168887.1.

(Continued)

*Primary Examiner* — Zelalem Eshete
(74) *Attorney, Agent, or Firm* — Oblon, McClelland, Maier & Neustadt, L.L.P.

(57) ABSTRACT

A roller lifter for internal combustion engines is provided, which has higher rigidity of the lifter body, prevents cocking in the cylinder, and can achieve a size reduction. The roller lifter includes a cylindrical lifter body having a sliding surface on an outer circumferential surface thereof and a roller rotatably attached to the lifter body via an axial support pin and making contact with a rotating cam lobe. The lifter body includes a pair of support portions supporting the axial support pin. The axial support pin is mechanically fastened to the pair of support portions, with both ends thereof inserted in support holes formed in the support portions. The lifter body includes an anti-rotation retainer extending radially outward from the sliding surface. The sliding surface is formed on both front and rear sides in the sliding direction of the anti-rotation retainer.

19 Claims, 7 Drawing Sheets

(56) References Cited

FOREIGN PATENT DOCUMENTS

| | | | |
|---|---|---|---|
| JP | 2011-169154 | A | 9/2011 |
| WO | WO 2013/119214 | A1 | 8/2013 |

OTHER PUBLICATIONS

Japanese Office Action Issued Mar. 15, 2016 in JP Patent Application No. 2012-138596 with English translation.

* cited by examiner

ROLLER LIFTER FOR INTERNAL COMBUSTION ENGINE

CROSS-REFERENCE

This application claims priority to Japanese patent application no. 2012-138596 filed on Jun. 20, 2012, the contents of which are entirely incorporated herein by reference.

FIELD OF THE INVENTION

The present invention relates to a roller lifter for internal combustion engines used in car engines or the like.

BACKGROUND ART

There are known pump lifters used for fuel supply pumps or valve lifters used for valve gears in internal combustion engines such as car engines or the like.

Some of these lifters include a roller at a portion directly contacting a cam lobe provided in fuel supply pumps or valve gear to reduce friction resistance against the cam lobe and to improve wear resistance of the surface contacting the cam lobe (hereinafter referred to as "roller lifter 9").

The roller lifter 9 is configured, as shown in FIG. 12, with a roller 93 attached to a lifter body 92 having a sliding surface 924 that slides on the inner wall of a cylinder in which the roller lifter 9 is installed. To fabricate the roller lifter, the roller 93 is first placed between a pair of support portions 921 provided to the lifter body 92. An axial support pin 94 of the roller 93 is inserted into support holes 922 formed in the support portions 921, and both ends of the axial support pin 94 are compressed using a hydraulic press or the like to deform the ends to increase their diameters, to mechanically fasten the axial support pin 94 to the support portions 921.

The roller 93 of the roller lifter 9 and the cam lobe are arranged such that their respective rotation axes are parallel, so as to minimize friction resistance between the roller and the cam lobe. For this reason, the lifter body 92 of the roller lifter 9 is formed with an anti-rotation retainer 923 to prevent displacement of the rotation axis of the roller 93, i.e., to prevent the lifter body 92 from rotating relative to the inner wall of the cylinder (see Patent Document 1).

This anti-rotation retainer 923 is formed at one axial end of the lifter body 92 by cutting and bending processes using, for example, a cutting tool or a press. More specifically, the anti-rotation retainer 923 is formed by cutting off part of one end of a cylindrical metal member to form a protruding piece of a predetermined size axially protruding from one end of the lifter body 92, and by bending the protruding piece to protrude radially outward.

The protruding piece needs to be bent largely outward in the radial direction from inside. Therefore, the radial part of the lifter body 92 opposite the protruding piece had to be largely cut off, except for the support portions 921, to form the anti-rotation retainer 923, as shown in FIG. 12.

PATENT DOCUMENT

Patent Document 1: JP-A-2010-1884

SUMMARY OF THE INVENTION

However, the roller lifter 9 shown in Patent Document 1 may have lower rigidity because part of the cylindrical metal member that is the component forming the lifter body 92 is largely cut off as mentioned above. Accordingly, there is a possibility that the lifter body 92 may deform when the axial support pin 94 is mechanically fastened to the support portions 921, and the circularity accuracy of the sliding surface 924 may be lowered.

Moreover, as the lifter body 92 is largely cut off by cutting and pressing as mentioned above, the lifter body 92 tends to have a small length in the front to back direction (axial direction) of the region where the sliding surface 924 is formed. That is, the distance between the front end and the rear end of the sliding surface 924 (hereinafter referred to as "sliding length") tends to be short. This may result in large cocking (wobbling) in the cylinder when the roller lifter 9 is installed in an internal combustion engine. Namely, the shorter the sliding length is, the larger the maximum inclination angle of the lifter body 92 becomes relative to the sliding axis, when the roller lifter 9 is installed in an internal combustion engine. The surface pressure between the lifter body 92 and the inner wall of the cylinder tends to be larger accordingly, and the increased friction resistance may impede smooth sliding of the roller lifter 9.

To prevent the cocking in the cylinder, it is conceivable to design the lifter body 92 to have a longer sliding length in the sliding surface 924. However, in a configuration in which the cut-off portion is located on the rear side in the axial direction as described above, increasing the length of the sliding surface 924 would simply increase the length in the front to back direction (axial direction) of the lifter body 92, leading to bulkiness of the lifter body 92.

The present invention was made in view of such problems and its object is to provide a roller lifter for internal combustion engines, which has higher rigidity of the lifter body, prevent cocking in the cylinder, and can achieve a size reduction.

One aspect of the invention resides in a roller lifter for internal combustion engines, including

- a cylindrical lifter body including a sliding surface on an outer circumferential surface thereof that slides on an inner wall of a cylinder; and
- a roller rotatably attached to the lifter body via an axial support pin and making contact with a rotating cam lobe;
- the lifter body further including a pair of support portions supporting the axial support pin, the axial support pin being mechanically fastened to the pair of support portions, with both ends thereof inserted in support holes formed in the support portions, and an anti-rotation retainer extending radially outward from the sliding surface, wherein
- the sliding surface is formed on both front and rear sides in a sliding direction of the anti-rotation retainer (claim 1).

The anti-rotation retainer in the roller lifter for internal combustion engines extends radially outward from the sliding surface of the lifter body. Therefore, the lifter body need not be cut off largely to form the anti-rotation retainer. The lifter body can have higher rigidity accordingly, so that the circularity accuracy of the sliding surface can be maintained when the axial support pin is mechanically fastened to the support portions.

The sliding surface of the lifter body is formed on the front side and the rear side in the sliding direction of the anti-rotation retainer. Therefore, the distance (sliding length) between the front end and the rear end of the sliding surface of the lifter body can be made longer. As a result, the roller lifter can be prevented from cocking relative to the inner wall of the cylinder.

As the sliding length can be made sufficiently large without particularly increasing the axial length of the lifter body, a size reduction of the lifter body can also be achieved.

The invention can thus provide a roller lifter for internal combustion engines, which has higher rigidity of the lifter body, prevent cocking in the cylinder, and can achieve a size reduction.

DESCRIPTION OF THE EMBODIMENTS

The roller lifter for internal combustion engines can be used, for example, as a pump lifter for a fuel supply pump or a valve lifter for a valve gear in an internal combustion engine such as a car engine.

Herein, one side of the lifter body on which support portions are provided, i.e., the side that will make contact with the cam lobe, will be referred to as the rear side in the sliding direction, and the opposite side will be referred to as the front side in the sliding direction.

The sliding surface may preferably be split into a front sliding surface formed on the front side of the anti-rotation retainer and a rear sliding surface formed on the rear side of the anti-rotation retainer, and a small diameter part having a surface recessed radially inward from the sliding surface may be formed between the front sliding surface and the rear sliding surface, with the anti-rotation retainer extending from this small diameter part (claim 2).

This allows for highly accurate formation of the sliding surface. Namely, as the front sliding surface and the rear sliding surface are formed to the front and the back of the small diameter part where the anti-rotation retainer is formed, the anti-rotation retainer extending radially outward from the sliding surface does not get in the of when machining these sliding surfaces. The small diameter part, which cannot be easily polished as the anti-rotation retainer is formed there, need not be polished, as it is formed radially inward from the sliding surface and does not contact the inner wall of the cylinder.

The anti-rotation retainer may preferably have a contour formed at least partly by punching out part of the lifter body to extend radially outward (claim 3). The anti-rotation retainer can thus be formed integral with the lifter body by forging. The production cost can be reduced accordingly. Also, punching out part of the lifter body allows for highly accurate formation of end faces of the anti-rotation retainer. The anti-rotation retainer can thus provide its function of stopping rotation effectively.

EXAMPLES

Example 1

Specific embodiments of the roller lifter for internal combustion engines will be described below with reference to FIGS. 1 to 5.

Figure 1:
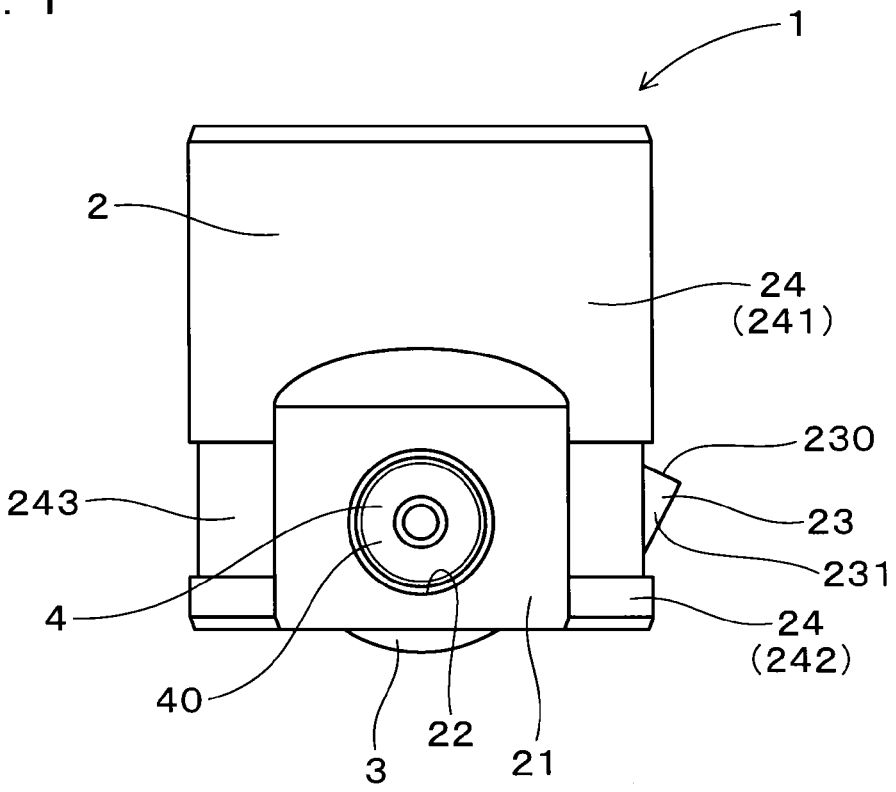
FIG. 1 is a front view of a roller lifter in Embodiment 1.
Figure 5:
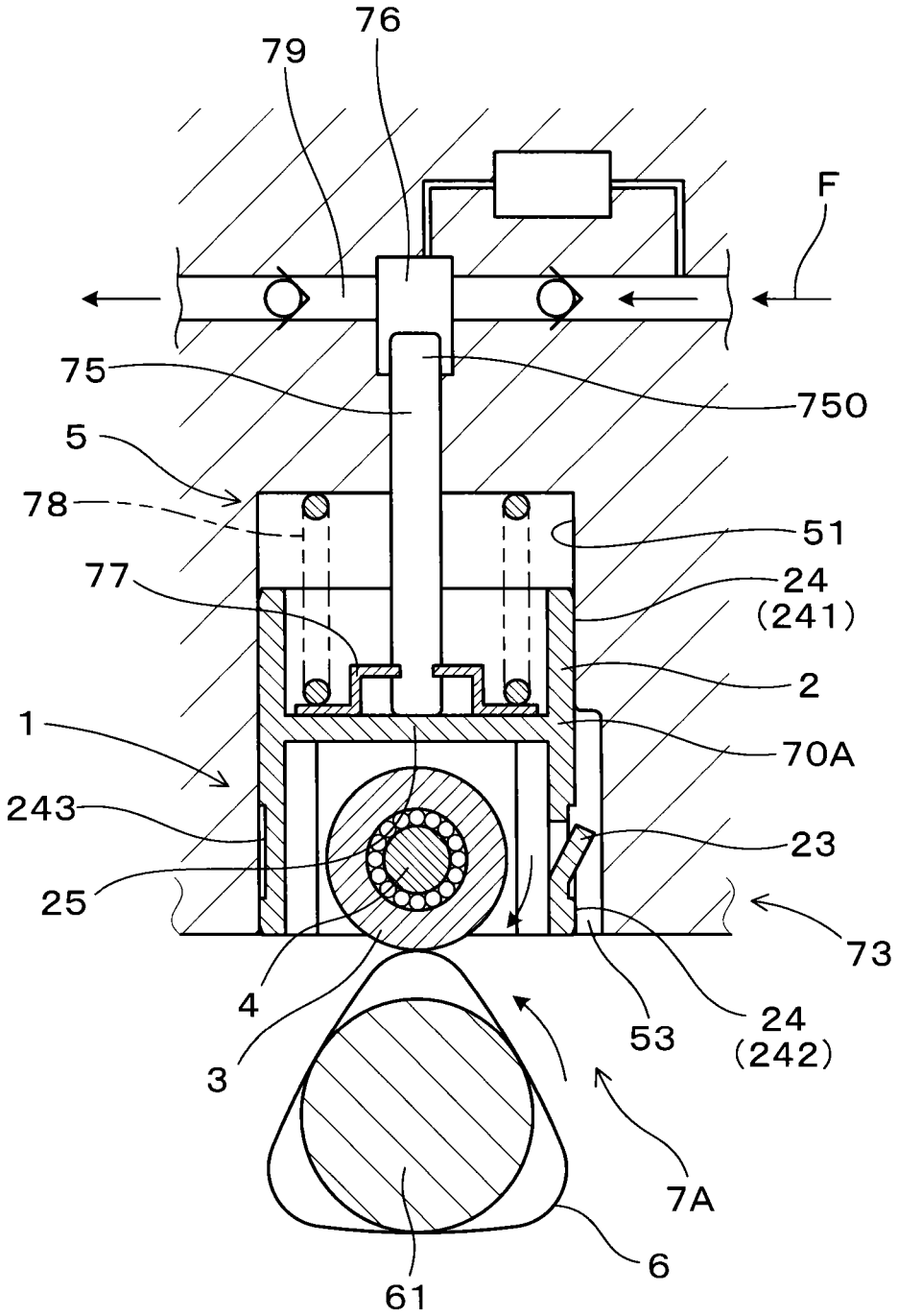
FIG. 5 is a cross-sectional diagram illustrating a sliding mechanism where the roller lifter is used as a pump lifter in Embodiment 1.

The roller lifter 1 for internal combustion engines of this embodiment includes a cylindrical lifter body 2 having a sliding surface 24 on its outer circumferential surface that slides on an inner wall 51 of a cylinder 5, and a roller 3 rotatably attached to the lifter body 2 with an axial support pin 4 and making contact with a rotating cam lobe 6, as shown in FIGS. 1 and 5.

The lifter body 2 has a pair of support portions 21 for supporting the axial support pin 4.

Both ends 40 of the axial support pin 4 are inserted in support holes 22 formed in the pair of support portions 21 and mechanically fastened thereto.

The lifter body 2 has an anti-rotation retainer 23 extending radially outward from the sliding surface 24. The sliding surface 24 is formed both on the front and rear sides in the sliding direction of the anti-rotation retainer 23.

The sliding surface 24 is split into two parts: a front sliding surface 241 formed to the front of the anti-rotation retainer 23 and a rear sliding surface 242 formed to the rear of the anti-rotation retainer 23.

A small diameter part 243, where the surface is recessed radially inward from the sliding surface 24, is formed between the front sliding surface 241 and the rear sliding surface 242.

Figure 2:
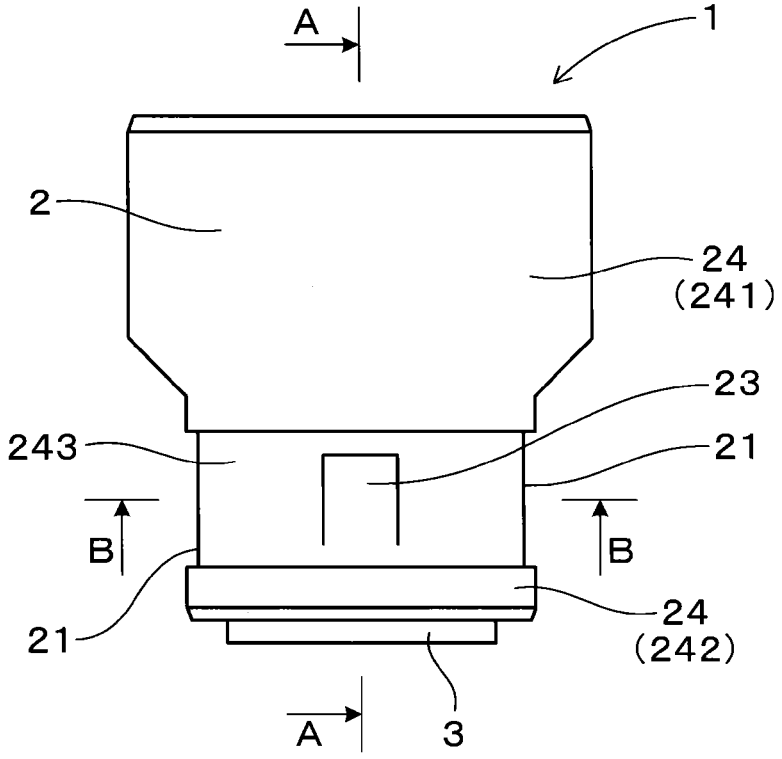
FIG. 2 is a side view of the roller lifter in Embodiment 1.
Figure 3:
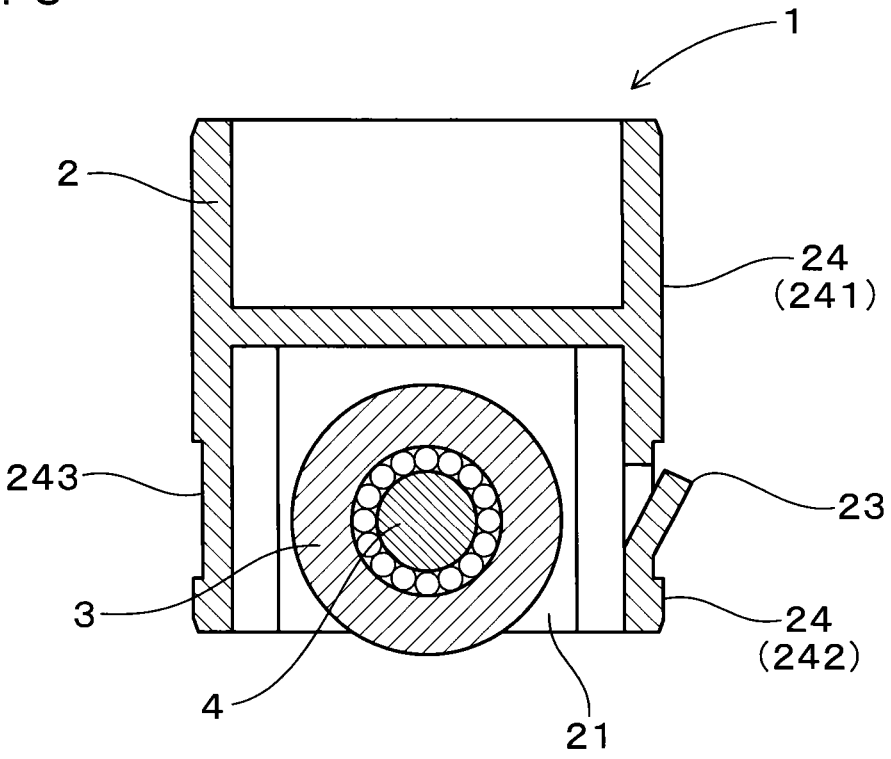
FIG. 3 is a cross section along A-A of FIG. 2 viewed from the direction of the arrow.
Figure 4:
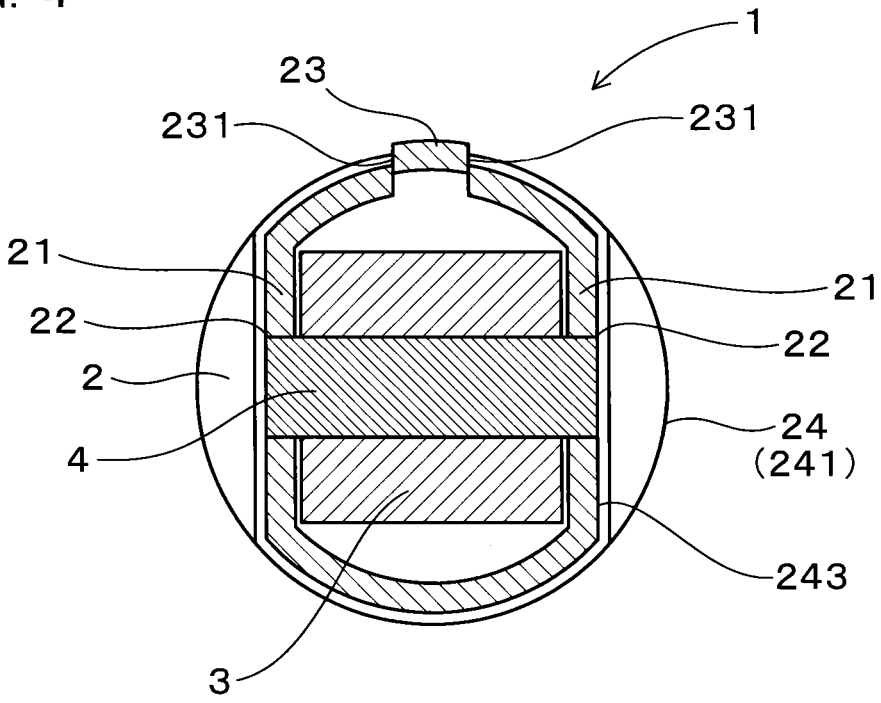
FIG. 4 is a cross section along B-B of FIG. 2 viewed from the direction of the arrow.

The anti-rotation retainer 23 extends from the small diameter part 243, as shown in FIGS. 2 to 4. The anti-rotation retainer 23 has a contour that is partly formed by punching out part of the lifter body 2 to extend radially outward.

The lifter body 2 is substantially cylindrical, and the sliding surface 24 has a cross section that is a perfect circle, or part of a perfect circle, in a direction orthogonal to the sliding direction.

The rear sliding surface 242 of the sliding surface 24 is formed near the rear end of the lifter body 2, while the front sliding surface 241 extends from near the front end to around the center of the lifter body 2. The small diameter part 243 is formed between the front sliding surface 241 and the rear sliding surface 242. The small diameter part 243 has a length in the sliding direction that is shorter than that of the front sliding surface 241 but longer than that of the rear sliding surface 242. The small diameter part 243 is recessed by about 100 μm or more, for example, inward relative to the sliding surface 24.

The front end and the rear end of the lifter body 2 are chamfered.

The pair of support portions 21 extends from the rear end of the lifter body 2 to further than the front end of the small diameter part 243. The pair of support portions 21 has flat outer surfaces parallel to each other. The outer surfaces of the support portions 21 are located on an inner side at least than the sliding surface 24.

The anti-rotation retainer 23 is formed in the small diameter part 243. The anti-rotation retainer 23 is formed by forging, such as to punch out part of the wall that forms the cylindrical lifter body 2. More specifically, the rear end in the sliding direction of the anti-rotation retainer 23 is formed continuous with the small diameter part 243, while the front end and a pair of side ends are cut out from the small diameter part 243. The anti-rotation retainer 23 inclines such that the height of protrusion increases gradually from the rear end toward the front end. The front end of the anti-rotation retainer 23 protrudes radially outward from the sliding surface 24. Thus, a front end face 230 and part of the pair of side end faces 231 of the anti-rotation retainer 23 are exposed from the small diameter part 243.

The sliding surface 24 of the lifter body 2 is polished so as to have a perfect circular outline.

As shown in FIG. 1, the anti-rotation retainer 23 is formed by punching out part of the small diameter part 243 such as to have a triangular shape, with the side end face 231 extending therefrom, when viewed from a direction orthogonal to the side end face 231.

To assemble the roller 3 to the lifter body 2, as shown in FIGS. 1 to 4, the roller 3 is fitted in between the pair of support portions 21, and the axial support pin 4 is inserted into the support holes 22 such that both ends 40 thereof protrude outward from the pair of support portions 21.

The both ends 40 of the axial support pin 4 are then pressed axially by a hydraulic press or the like so that both ends 40 deform to increase their diameter, thereby to mechanically fasten the axial support pin 4 to the support portions 21.

The roller lifter 1 of this embodiment may be used as a pump lifter 70A for a fuel supply pump 7A, for example, in an internal combustion engine such as a car engine, as shown in FIG. 5.

The roller lifter 1 of this embodiment may be installed, for example, such that the lifter body 2 having the sliding surface 24 slides on the inner wall 51 of a cylinder 5 in the fuel supply pump 7A and that the roller 3 makes contact with a rotating cam lobe 6, as shown in FIG. 5.

The fuel supply pump 7A is configured to compress fuel F supplied from a fuel tank (not shown) to feed the compressed fuel F to an injector (not shown) in synchronism with the cam lobe 6 on a cam shaft 61 in a reciprocal engine, as shown in FIG. 5.

The pump lifter 70A in the fuel supply pump 7A is configured to slide inside the cylinder 5 arranged in a cylinder head 73 of the reciprocal engine, as the roller 3 is rotated by the rotating cam lobe 6.

The pump lifter 70A is configured to make contact with one end of a plunger 75 arranged slidable inside the cylinder head 73 to slide the plunger 75, to compress the fuel F in a pressure chamber 76 formed inside the cylinder head 73 with the other end 750 of the plunger 75. As shown in the FIG. 5, the pump lifter 70A (roller lifter 1) is formed with a plate-like abutting portion 25 inside the lifter body 2 that has an annular cross-sectional shape.

A retainer 77 is secured to the outer circumference of the plunger 75 such as to make contact with the abutting portion 25. A spring 78 is disposed between the retainer 77 and the cylinder head 73 to bias the pump lifter 70A toward the cam lobe 6.

As shown in the FIG. 5, the anti-rotation retainer 23 of the lifter body 2 fits in an anti-rotation groove 53 formed along the axial direction of the cylinder 5 in the cylinder head 73 such as to be slidable along the sliding direction.

The pressure chamber 76 is formed midway of a fuel supply passage 79 that runs inside the cylinder head 73 such as to communicate the fuel tank and the injector.

This embodiment has the following advantageous effects:

The anti-rotation retainer 23 in this embodiment extends radially outward from the sliding surface 24 of the lifter body 2. Therefore, the lifter body 2 need not be cut off largely to form the anti-rotation retainer 23. The lifter body 2 can have higher rigidity accordingly, so that the circularity accuracy of the sliding surface 24 can be maintained when the axial support pin 4 is mechanically fastened to the support portions 21.

The sliding surface 24 of the lifter body 2 is formed on the front side and the rear side of the anti-rotation retainer 23 in the sliding direction of the lifter body 2. Therefore, the distance (sliding length) between the front end and the rear end of the sliding surface 24 of the lifter body 2 can be made longer. As a result, the roller lifter 1 can be prevented from cocking relative to the inner wall 51 of the cylinder 5.

As the sliding length can be made sufficiently large without particularly increasing the axial length of the lifter body 2, a size reduction of the lifter body 2 can also be achieved.

The sliding surface 24 is split into the front sliding surface 241 formed to the front of the anti-rotation retainer 23 and the rear sliding surface 242 formed to the rear of the anti-rotation retainer 23. The anti-rotation retainer 23 extends from the small diameter part 243, which is recessed radially inward from the sliding surface 24 and formed between the front sliding surface 241 and the rear sliding surface 242.

This allows for highly accurate formation of the sliding surface 24. Namely, as the front sliding surface 241 and the rear sliding surface 242 are formed to the front and the back of the small diameter part 243 where the anti-rotation retainer 23 is formed, the anti-rotation retainer 23 extending radially outward from the sliding surface 24 does not get in the way of machining these sliding surfaces. The small diameter part 243, which cannot be easily polished as the anti-rotation retainer 23 is formed there, need not be polished, as it is recessed radially inward from the sliding surface 24 and does not contact the inner wall 51 of the cylinder 5.

The anti-rotation retainer 23 is formed by punching out part of the lifter body 2 so that its contour partly extends radially outward. The anti-rotation retainer 23 can thus be formed integrally with the lifter body 2 by forging. The production cost can be reduced accordingly.

When the anti-rotation retainer 23 is formed, a punch presses part of the lifter body 2 from inside and a die with an opening attached on the outside of the lifter body for the punched portion to escape serves as a receiver. Therefore, the anti-rotation retainer 23 can have shear cross sections as the side end faces 231 and the front end face 230, i.e., the anti-rotation retainer 23 can have highly accurate end faces. Namely, if part of the lifter body 2 is protruded radially outward by plastic deformation instead of by punching to provide the anti-rotation retainer 23, the contour of the anti-rotation retainer 23 would take a shape of a round boss protruded continuously from the lifter body 2. It would be hard to control the contour of the anti-rotation retainer 23, and to achieve a contour exactly as designed to conform to the anti-rotation groove 53. Therefore, the anti-rotation retainer 23 would have to be subjected to another process such as cutting after the plastic deformation, in order to suitably function as the anti-rotation retainer.

By punching out part of the lifter body 2 to form part of the contour of the anti-rotation retainer 23, the punched-out contour portions (side end faces 231 and the front end face 230) are cut out from the lifter body 2 and form shear cross sections. The punched out contour portions will not be curved, as mentioned above, like a round boss protruding continuously from the lifter body 2. The contour of the anti-rotation retainer 23 is more controllable when forming the anti-rotation retainer 23. As a result, the contour of the side end faces 231 and the front end face 230 of the anti-rotation retainer 23 can be easily and accurately made into a shape as designed. The anti-rotation retainer 23 can thus exhibit its function of stopping rotation effectively. Moreover, as punching allows collective formation of a plurality of anti-rotation retainers 23, the number of process steps can also be reduced.

According to this embodiment, as described above, a roller lifter for internal combustion engines, which has higher rigidity of the lifter body, prevent cocking in the cylinder, and can achieve a size reduction, can be provided.

Example 2

This embodiment is an example in which the roller lifter 1 is used as a valve lifter 70B in a valve gear 7B of a reciprocal engine.

The roller lifter 1 itself is configured the same as the roller lifter 1 of Embodiment 1.

Figure 6:
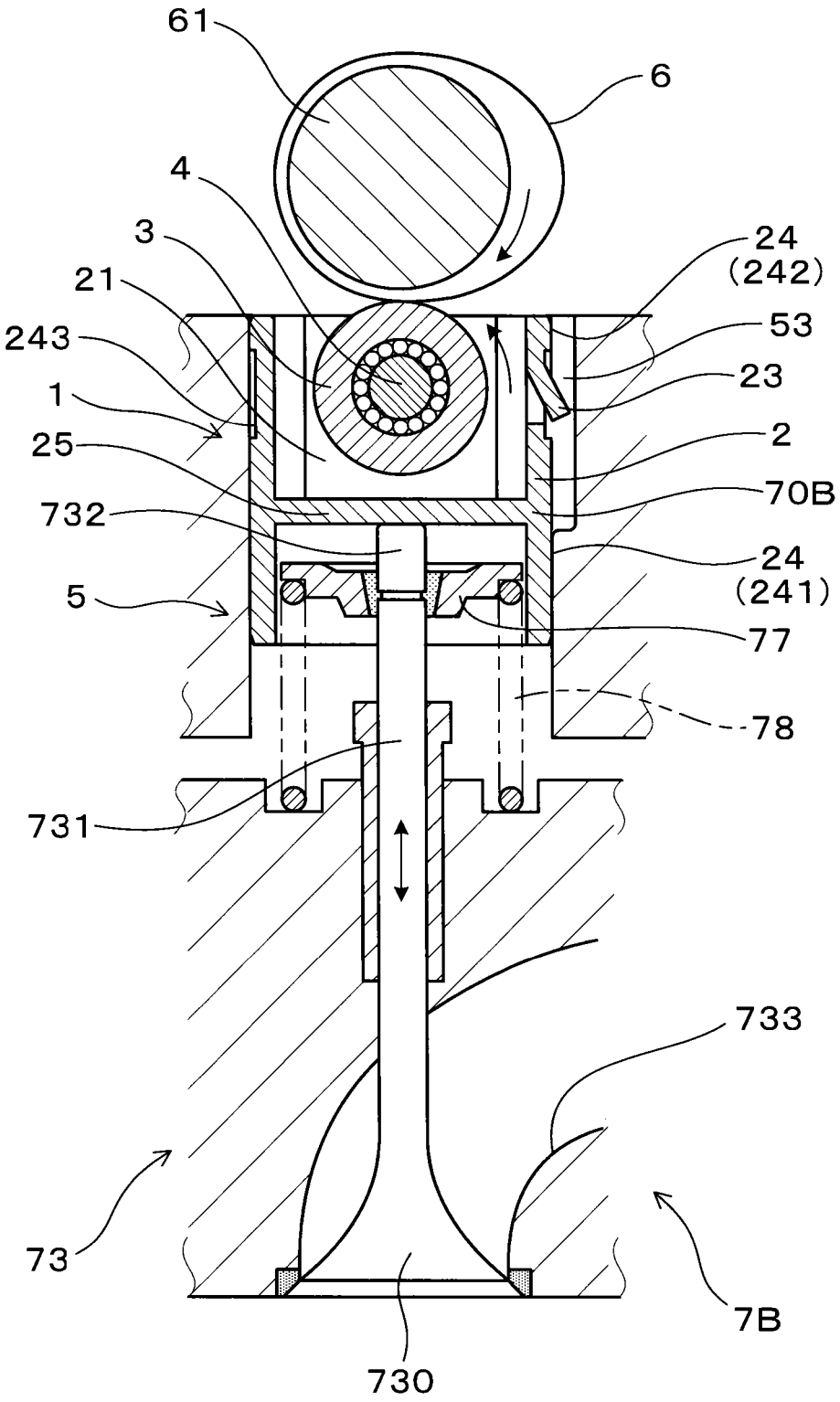
FIG. 6 is a cross-sectional diagram illustrating a sliding mechanism where the roller lifter is used as a pump lifter in Embodiment 2.

The valve lifter 70B in the valve gear 7B is configured to slide inside a cylinder 5 arranged in a cylinder head 73 of the reciprocal engine, as the roller 3 is rotated by the rotating valve gear cam lobe 6 formed on a cam shaft 61 of the reciprocal engine, as shown in FIG. 6.

The valve lifter 70B abuts on a stem distal end 732 of a valve 730 in the reciprocal engine, and is arranged slidable up and down inside the cylinder 5 such as to open and close the valve 730 disposed to open and close an intake/exhaust port (intake port or exhaust port) 733.

An abutting portion 25 is configured to abut on the stem distal end 732 of the valve 730.

A retainer 77 is secured to the outer circumference of a stem part 731 of the valve 730. A spring 78 is disposed between the retainer 77 and the cylinder head 73 to bias the valve lifter 70B toward the cam lobe 6.

The rest is the same as Embodiment 1, with similar advantageous effects.

Example 3

Figure 7:
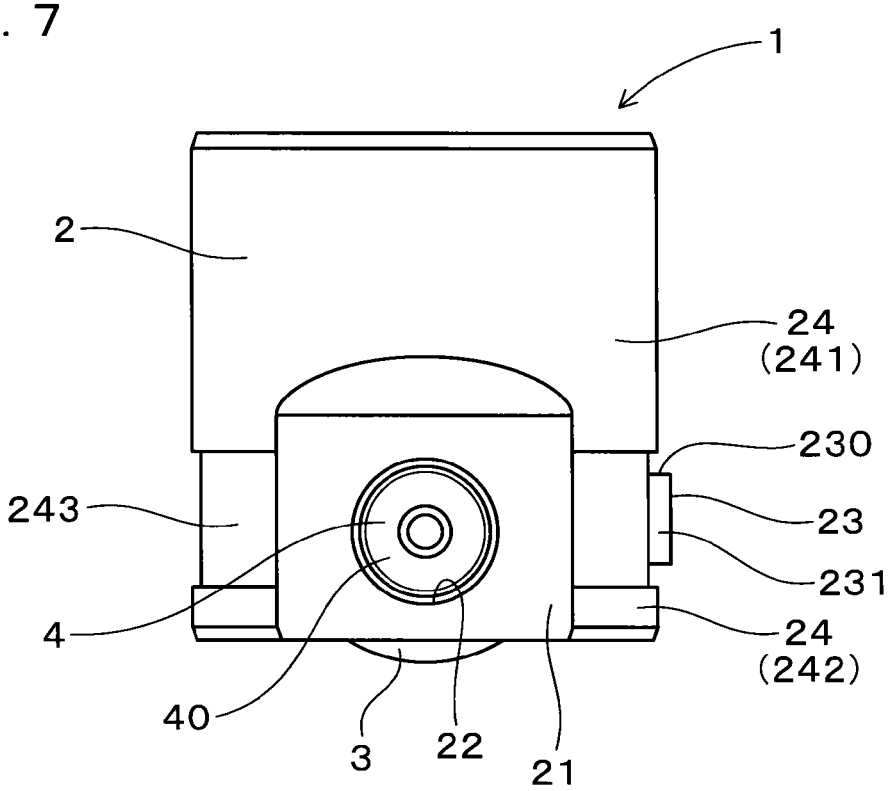
FIG. 7 is a front view of a roller lifter in Embodiment 3.
Figure 8:
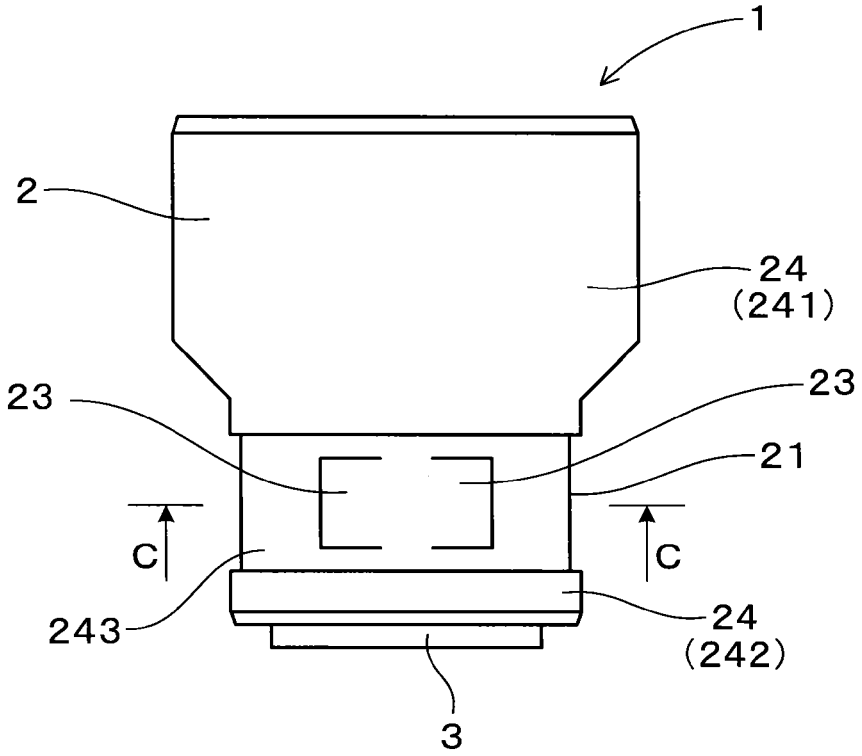
FIG. 8 is a side view of the roller lifter in Embodiment 3.
Figure 9:
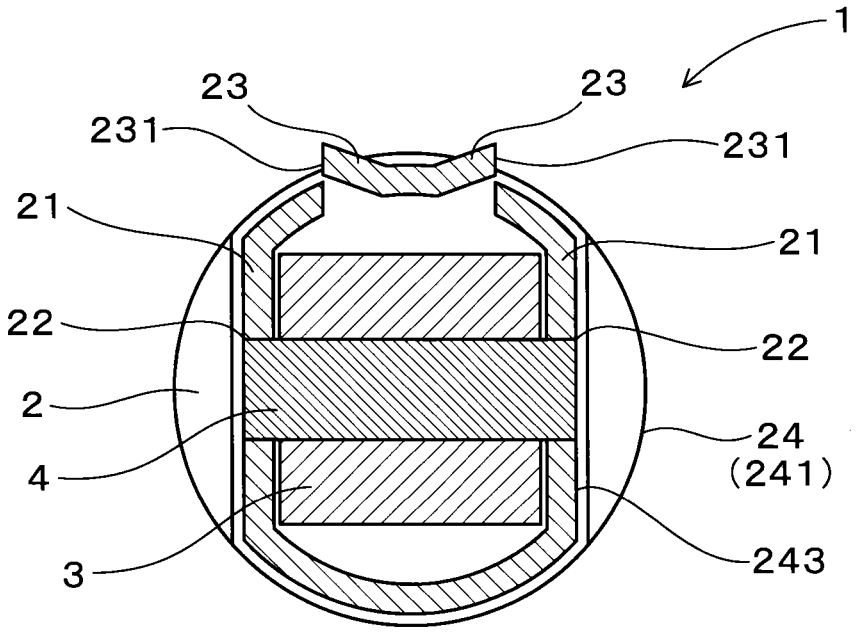
FIG. 9 is a cross section along C-C of FIG. 8 viewed from the direction of the arrow.

As shown in FIGS. 7 to 9, this embodiment is an example of the roller lifter 1, in which one end in a direction orthogonal to the sliding direction of the anti-rotation retainer 23 is continuous with the small diameter part 243 while the other end extends radially outward from the sliding surface 24.

The roller lifter 1 of this embodiment has a pair of anti-rotation retainers 23. The respective ends of the anti-rotation retainers 23 that are continuous with the small diameter part 243 face each other, while the other ends (side end faces 231) are oriented to mutually opposite directions.

The side end faces 231 are formed such as to face the inner side face of the anti-rotation groove 53 (see FIG. 5) when the roller lifter 1 is mounted to the cylinder 5.

The rest is the same as Embodiment 1, with similar advantageous effects.

Example 4

Figure 10:
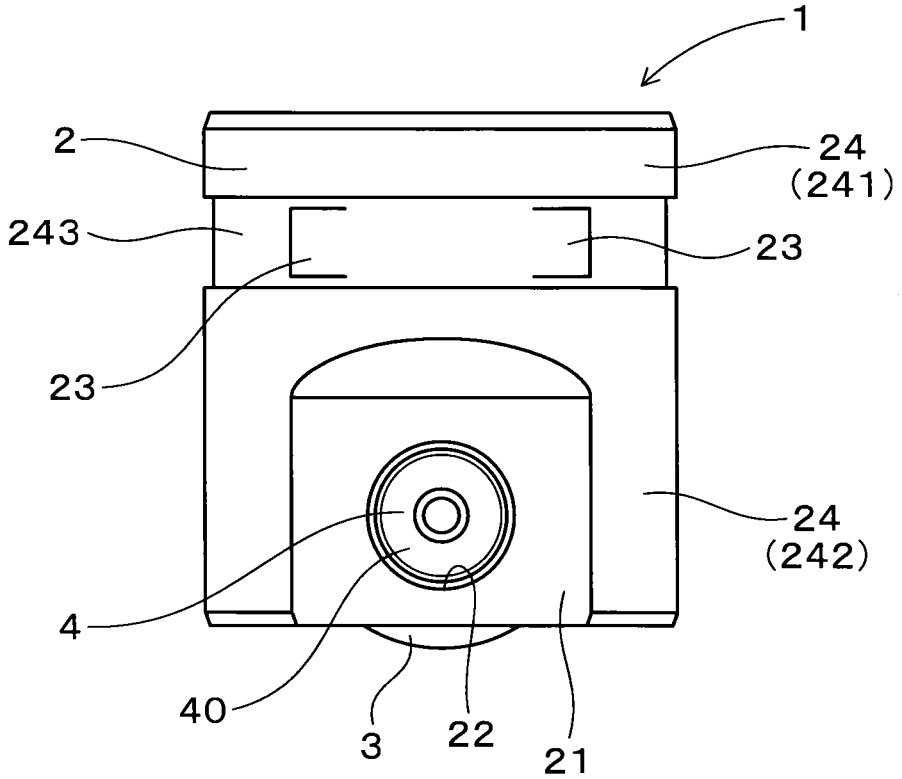
FIG. 10 is a front view of a roller lifter in Embodiment 4.
Figure 11:
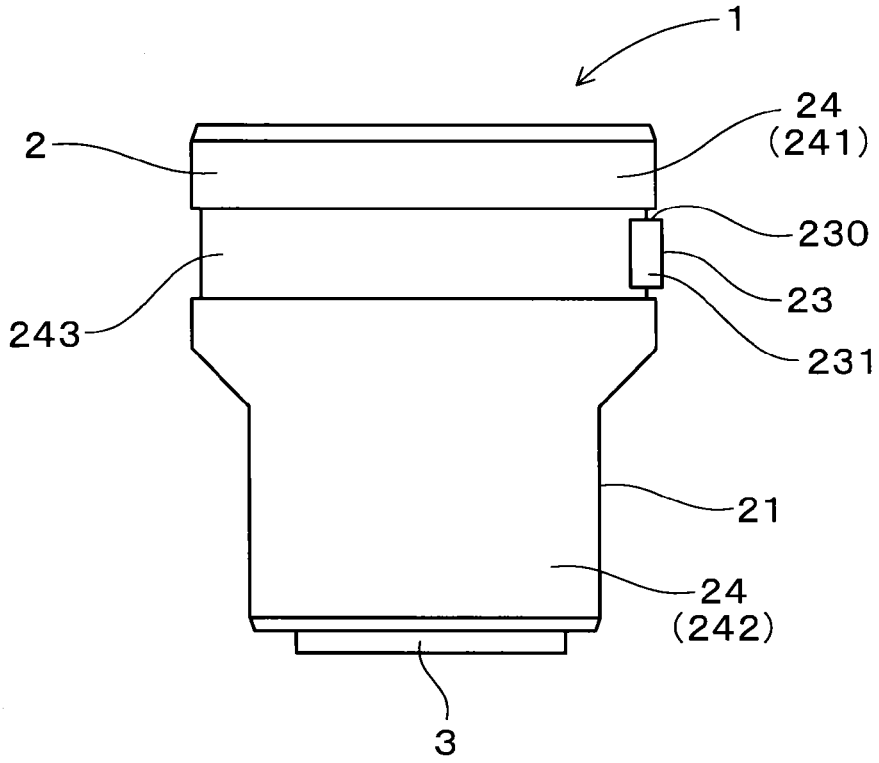
FIG. 11 is a side view of the roller lifter in Embodiment 4.
Figure 12:
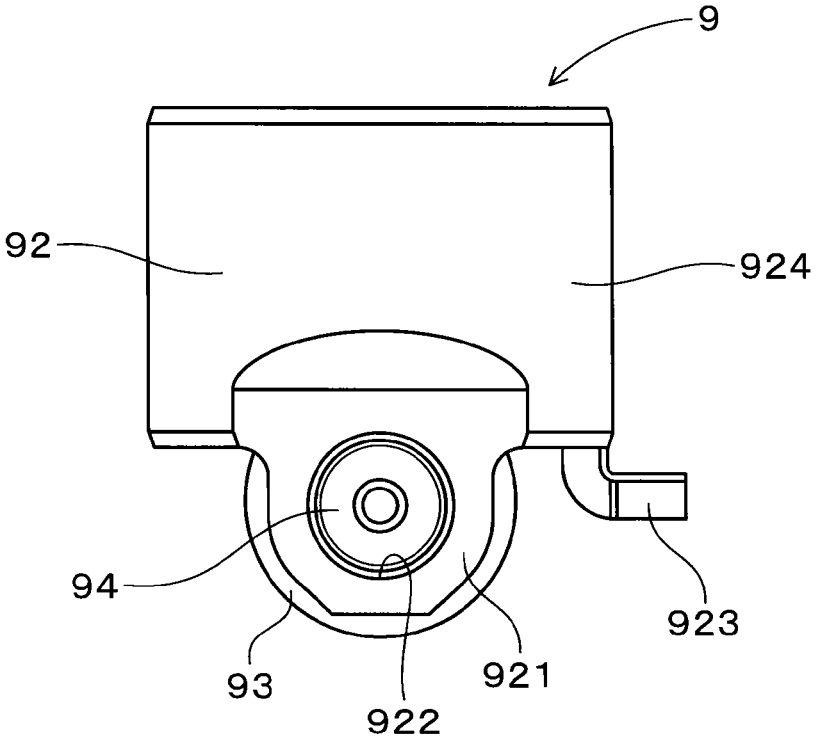
FIG. 12 is a front view of a prior art roller lifter.

As shown in FIGS. 10 and 11, this embodiment is an example of the roller lifter 1, in which the small diameter part 243 is formed on the front side in the sliding direction of the support portions 21 of the lifter body 2. One end in a direction orthogonal to the sliding direction of the anti-rotation retainer 23 is continuous with the small diameter part 243, while the other end extends radially outward from the sliding surface 24.

The front sliding surface 241 of the roller lifter 1 of this embodiment is formed shorter than the rear sliding surface 242.

The rest is the same as Embodiment 3, with similar advantageous effects.

The invention claimed is:

1. A roller lifter for internal combustion engines, comprising:

a cylindrical lifter body including a sliding surface on an outer circumferential surface thereof that slides on an inner wall of a cylinder; and a roller rotatably attached to the lifter body via an axial support pin and making contact with a rotating cam lobe;

the lifter body further including a pair of support portions supporting the axial support pin, the axial support pin being mechanically fastened to the pair of support portions, with both ends thereof inserted in support holes formed in the pair of support portions, and a first anti-rotation retainer extending radially outward from the sliding surface, wherein the sliding surface is formed on both front and rear sides in a sliding direction of the first anti-rotation retainer, wherein the first anti-rotation retainer includes a first flat surface parallel to the sliding direction and extending radially outward from the sliding surface at a position between the front and rear sides of the sliding surface, wherein the sliding surface is split into a front sliding surface formed a front side of the first anti-rotation retainer and a rear sliding surface formed on a rear side of the first anti-rotation retainer, and wherein a small diameter part having a surface recessed radially inward from the sliding surface is formed between the front sliding surface and the rear sliding surface, the first anti-rotation retainer extending from this small diameter a so as to form an angle with the recessed surface.

2. The roller lifter for internal combustion engines according to claim 1, wherein the first anti-rotation retainer has a contour formed at least partly by punching out part of the lifter body to extend radially outward.

3. The roller lifter for internal combustion engines according to claim 1, wherein the first flat surface faces toward a circumferential direction of the lifter body.

4. The roller lifter for internal combustion engines according to claim 1, wherein the first flat surface forms an oblique angle with a circumferential direction of the lifter body.

5. The roller lifter for internal combustion engines according to claim 1, wherein the first anti-rotation retainer further includes a second flat surface parallel to the sliding direction and extending radially outward from the sliding surface, the second flat surface being spaced apart from the first flat surface in a circumferential direction of the lifter body.

6. The roller lifter for internal combustion engines according to claim 5, wherein the first and second flat surfaces are parallel to each other.

7. The roller lifter for internal combustion engines according to claim 1, further comprising:

a second anti-rotation retainer extending radially outward from the sliding surface, wherein the second anti-rotation retainer includes a first flat surface parallel to the sliding direction and extending radially outward from the sliding surface.

8. The roller lifter for internal combustion engines according to claim 7, wherein the first flat surface of the first anti-rotation retainer and the first flat surface of the second anti-rotation retainer are parallel to each other.

9. The roller lifter for internal combustion engines according to claim 1, wherein an inward end of the first anti-rotation retainer in a direction orthogonal to the sliding direction is continuous with the small diameter part and an outward end of the first anti-rotation retainer extends radially outward from the sliding surface.

10. The roller lifter for internal combustion engines according to claim 1, wherein the first anti-rotation retainer inclines such that a height of protrusion of the first anti-rotation retainer increases gradually along the sliding direction from an inward end that is continuous with the small diameter part to an outward end that protrudes radially outward from the sliding surface.

11. The roller lifter for internal combustion engines according to claim 10, wherein the first anti-rotation retainer forms a triangular shape when viewed from a direction orthogonal to the first flat surface.

12. The roller lifter for internal combustion engines according to claim 1, wherein the first anti-rotation retainer inclines such that a height of protrusion of the first anti-rotation retainer increases gradually along a circumferential direction of the lifter body from an inward end that is continuous with the small diameter part to an outward end that protrudes radially outward from the sliding surface.

13. The roller lifter for internal combustion engines according to claim 12, wherein a radially inward edge of the first flat surface of the first anti-rotation retainer is radially inward of the sliding surface and a radially outward edge of the first flat surface is radially outward of the sliding surface.

14. The roller lifter for internal combustion engines according to claim 12, further comprising:

a second anti-rotation retainer extending radially outward from the sliding surface, wherein the second anti-rotation retainer includes a first flat surface parallel to the sliding direction and extending radially outward from the sliding surface, wherein the second anti-rotation retainer inclines such that a height of protrusion of the second anti-rotation retainer increases gradually along the circumferential direction of the lifter body from an inward end that is continuous with the small diameter part to an outward end that protrudes radially outward from the sliding surface.

15. The roller lifter for internal combustion engines according to claim 14, wherein a radially inward edge of the first flat surface of the first anti-rotation retainer is radially inward of the sliding surface and a radially outward edge of the first flat surface of the first anti-rotation retainer is radially outward of the sliding surface and a radially inward edge of the first flat surface of the second anti-rotation retainer is radially inward of the sliding surface and a radially outward edge of the first flat surface of the second anti-rotation retainer is radially outward of the sliding surface.

16. The roller lifter for internal combustion engines according to claim 14, wherein the first flat surface of the first anti-rotation retainer is on the outward end of the first anti-rotation retainer and the first flat surface of the second anti-rotation retainer is on the outward end of the second anti-rotation retainer.

17. The roller lifter for internal combustion engines according to claim 14, wherein the first and second anti-rotation retainers are symmetrical about a plane normal to the circumferential direction.

18. The roller lifter for internal combustion engines according to claim 1, wherein the small diameter part has a length in the sliding direction longer than a length of the front sliding surface and shorter than the rear sliding surface.

19. The roller lifter for internal combustion engines according to claim 1, wherein the angle is acute.

* * * * *